US006152345A

United States Patent [19]

Griffin et al.

[11] Patent Number: 6,152,345

[45] Date of Patent: Nov. 28, 2000

[54] METHOD FOR CONTROLLING WIDTH-WISE EXPANSION OF A CONVEYED WEB

[75] Inventors: Wayne C. Griffin, Livonia; Theodore R. Boccuzzi, Penfield; Edward G. Soos, Middleport, all of N.Y.

[73] Assignee: Eastman Kodak Company, Rochester, N.Y.

[21] Appl. No.: 09/273,642

[22] Filed: Mar. 23, 1999

[51] Int. Cl.[7] ..... B65H 20/06

[52] U.S. Cl. ..... 226/172

[58] Field of Search ..... 226/172, 171; 394/421, 646

[56] References Cited

U.S. PATENT DOCUMENTS

| | | | |
|---|---|---|---|
| 2,875,890 | 3/1959 | Good . | |
| 3,266,690 | 8/1966 | Goettsch | 226/172 X |
| 3,656,993 | 4/1972 | Edwards et al. . | |
| 4,498,984 | 2/1985 | Kuckhermann . | |
| 4,984,728 | 1/1991 | Brinkmeir et al. . | |
| 5,287,637 | 2/1994 | Dixit et al. . | |
| 6,001,421 | 12/1999 | Ahonen et al. . | |
| 6,004,430 | 12/1999 | Ilvespaa et al. . | |

FOREIGN PATENT DOCUMENTS

| | | |
|---|---|---|
| 0516991 | 12/1992 | European Pat. Off. . |
| 55-135046 | 10/1980 | Japan . |
| 5-19898 | 3/1993 | Japan . |

*Primary Examiner*—Donald P. Walsh
*Assistant Examiner*—Collin A. Webb
*Attorney, Agent, or Firm*—Clyde E. Bailey; Stephen H. Shaw

[57] ABSTRACT

A method for controlling widthwise contraction of a conveyed web utilizes a serpentine web conveyance path. Web conveyance path may be formed by opposing first web carrier belts and opposing second web carrier belts forming a generally serpentine transport path for supporting opposite lateral edges of the conveyed web.

1 Claim, 6 Drawing Sheets

METHOD FOR CONTROLLING WIDTH-WISE EXPANSION OF A CONVEYED WEB

FIELD OF THE INVENTION

The invention relates generally to the field of web conveyance. More particularly, the invention concerns a method for controlling widthwise contraction of a conveyed web that restrains the conveyed web from shrinking during processing.

BACKGROUND OF THE INVENTION

In conventional web conveyance processes, conveyed web is exposed to various treatment protocols. These processes most typically include rollers to support the web and in some cases involve tenters to transport the web by restraining the edges.

In cases where the web is not stiff, rollers have been used to support the web. This method is inexpensive, but does not address concerns with web defect generation related to the roller contact. Defects such as scratches, surface replication/adhesion, and impressions are generated with roller contact in this method. In addition, wrap on the rollers does little to restrain the web in cases where web shrinkage due to applied tension is a concern. A variation of the roller supported conveyance is air conveyance. In this process, the web is supported by either air blown from plenums or air blown through porous rollers (as taught in Japanese Kokai Patent No. Sho 55[1980]-135046, titled, "Conveyor For Belt-Like Material," by Terasaka, et al., Publication Date Oct. 21, 1980). Air conveyance is disadvantaged where the web is susceptible to distortion from the air streams.

In cases where web defects and/or shrinkage is a concern, tenters have been used to avoid roller contact and provide widthwise restraint or orientation. Tenters are complex pieces of equipment with large potential for dirt generation and high installed costs. Tenters can also damage the edges where the edge of the web is fragile. Nakajima, et al. demonstrated a process for tentering sensitive webs in Japanese Patent No. 93/19898, titled, "Method For Drying Cellulose Triacetate Films," by Nakajima, et al., Publication Date Mar. 18, 1993. This technology is expensive and creates dirt by perforating the web edge to constrain it.

Therefore, there persists a need in the art for a method for conveying web of indeterminate length that prevents the conveyed web from shrinking during processing while not damaging sensitive webs.

SUMMARY OF THE INVENTION

It is, therefore, an object of the invention to provide a method for conveying web of indeterminate length that restrains it from shrinking.

Another object of the invention is to provide a method that restrains widthwise contraction of a moving web by supporting opposite lateral edges of the moving web through a generally serpentine web conveyance path.

A further object of the invention is to provide a method for conveying a web during treatment that results in more surface uniformity.

An important feature of the method of the invention is the step of forming a generally serpentine web conveyance path that provides moving support and widthwise restraint for the web along lateral edges of the web.

To accomplish these and other objects and features of the invention, there is provided, in one aspect of the invention, a method for controlling widthwise contraction of web to be conveyed, comprises the steps of:

(a) providing a source of web to be conveyed;

(b) forming a generally serpentine web conveyance path having an ingress lip to receive said web to be conveyed and an egress lip for releasing said web to be conveyed from said generally serpentine web conveyance path; and (c) introducing said web to be conveyed into said ingress lip of said generally serpentine web conveyance path for conveyance through said generally serpentine web conveyance path and then through said egress lip of said generally serpentine web conveyance path for subsequent independent treatment.

The method of the invention has several important advantages over prior art developments including its simplicity of design, construction, and use. Moreover, the method of the invention has the added advantage of improving surface uniformity of the processed web.

BRIEF DESCRIPTION OF THE DRAWINGS

These and other aspects, objects, features, and advantages of the present invention will be more clearly understood and appreciated from a review of the following detailed description of the preferred embodiments and appended claims, and by reference to the accompanying drawing. To facilitate understanding, identical reference numerals have been used, where possible, to designate identical elements that are common to the figures, and wherein:

DETAILED DESCRIPTION OF THE INVENTION

Figure 1:
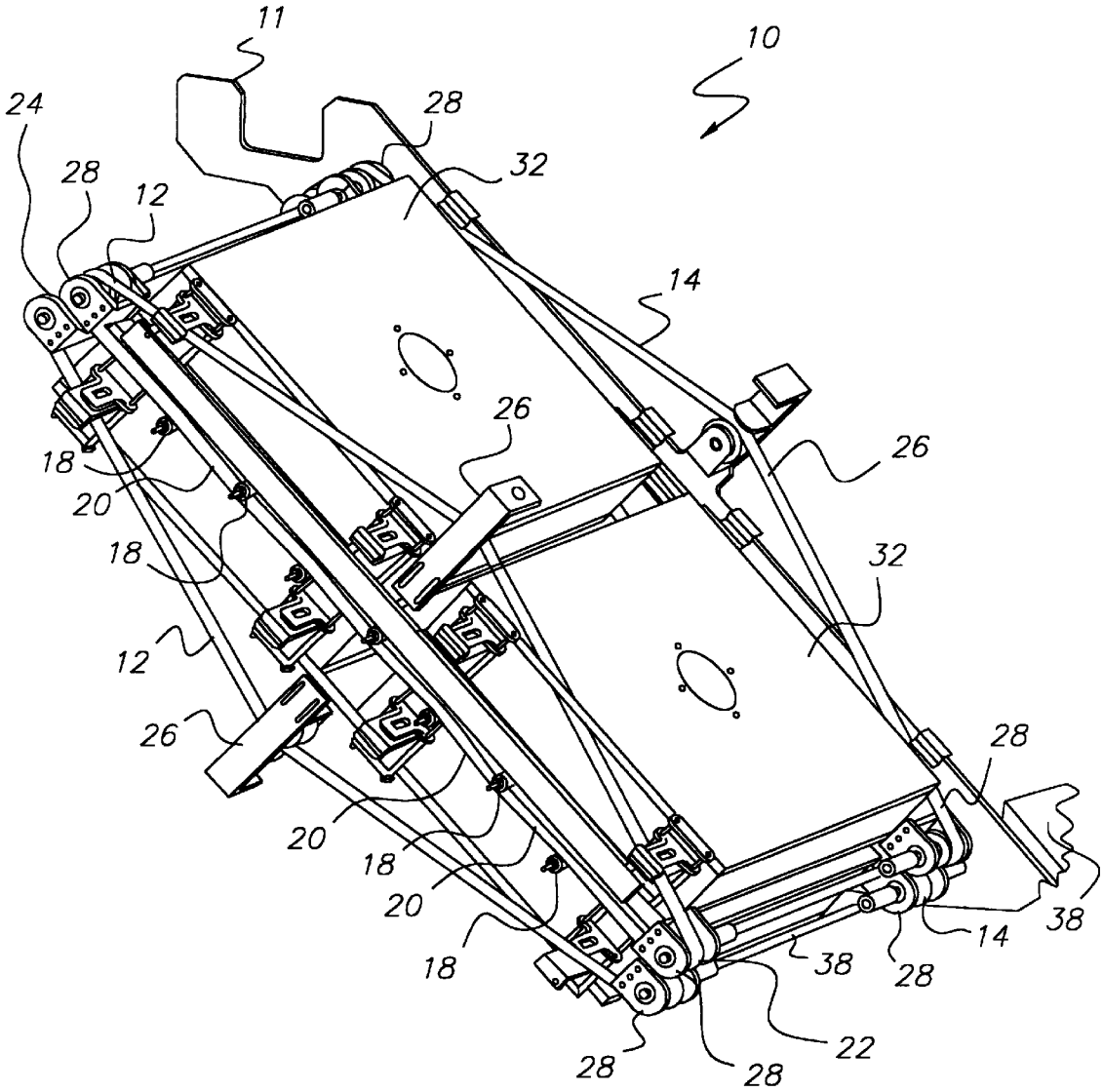
FIG. 1 is a perspective view of the apparatus of the invention.
Figure 2:
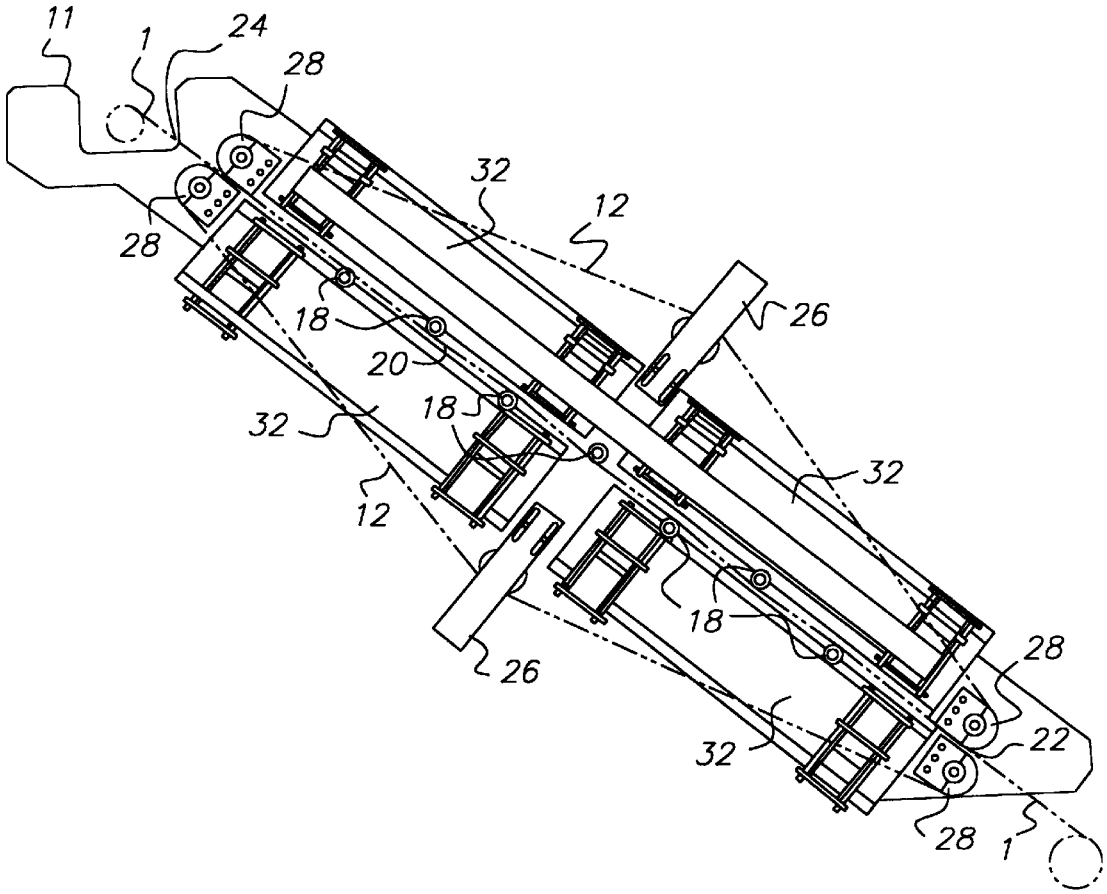
FIG. 2 is a side elevational view of the apparatus of the invention.

Turning now to the drawings and more particularly to FIGS. 1 and 2, apparatus 10 for conveying web 1 of indeterminate length is illustrated. It is useful to appreciate that web 1 may be any photographic sheet material such as solvent cast photographic film or paper having opposing lateral edges (not shown) which are tracked through a conveyance path, described herein, formed in apparatus 10.

Referring to FIG. 1, apparatus 10 includes a rigid, preferably metallic frame 11. Arranged in frame 11 is a pair of opposing first web carrier belts 12 for supporting a lateral edge (one edge shown in FIG. 6) of moving web 1. Spaced apart from opposing first web carrier belts 12 in frame 11 is a cooperating pair of similar opposing second web carrier belts 14 for supporting an opposite lateral edge (one edge shown in FIG. 6) of the moving web 1. First and second web carrier belts 12, 14 are supported by a plurality of belt support rollers 18 attached to the metallic frame 11. These belt support rollers 18 provide the path for first and second web carrier belts 12, 14. The belt support rollers 18 are in turn supported by bearings that allow them to rotate freely from the frame 11. First and second web carrier belts 12, 14 are manufactured out of materials that match the conditions of service and chemical exposure for the application. Materials such as stainless steel would work in a wide variety of applications. Applications that are sensitive to metallic dirt require polymeric carrier belt materials. Fiber reinforced materials such as reinforced butyl rubber were most preferred for this application. However, many other polymer systems would apply for different chemical environments.

Figure 3:
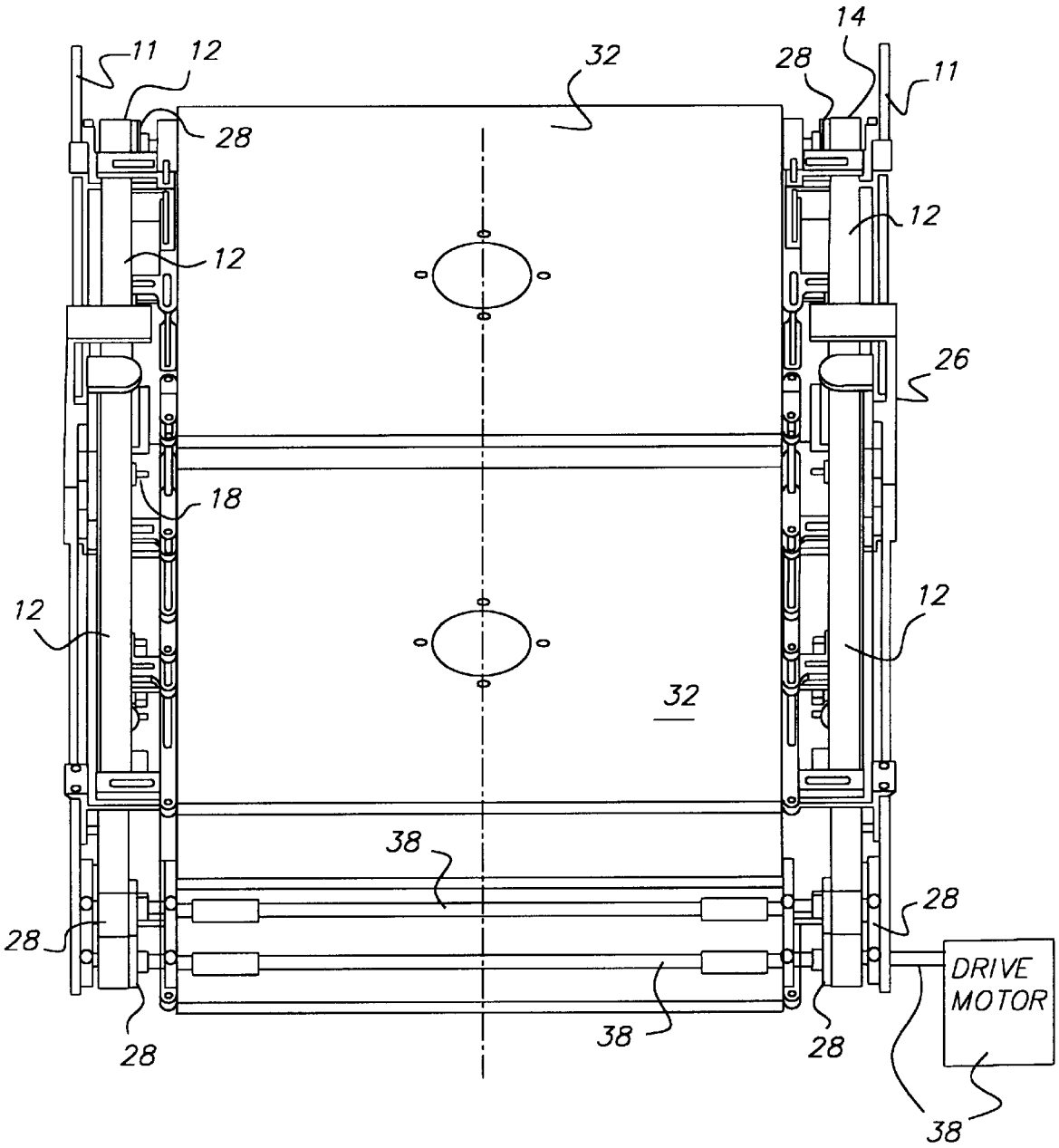
FIG. 3 is a front elevational view of the apparatus of the invention.

Referring to FIGS. 1 and 3, first and second web carrier belts 12, 14 are synchronously driven by a drive means 38, preferably a motor drive. Skilled artisans will appreciate that other means may be employed to drive first and second web carrier belts 12, 14 including the web 1.

Figure 5B:
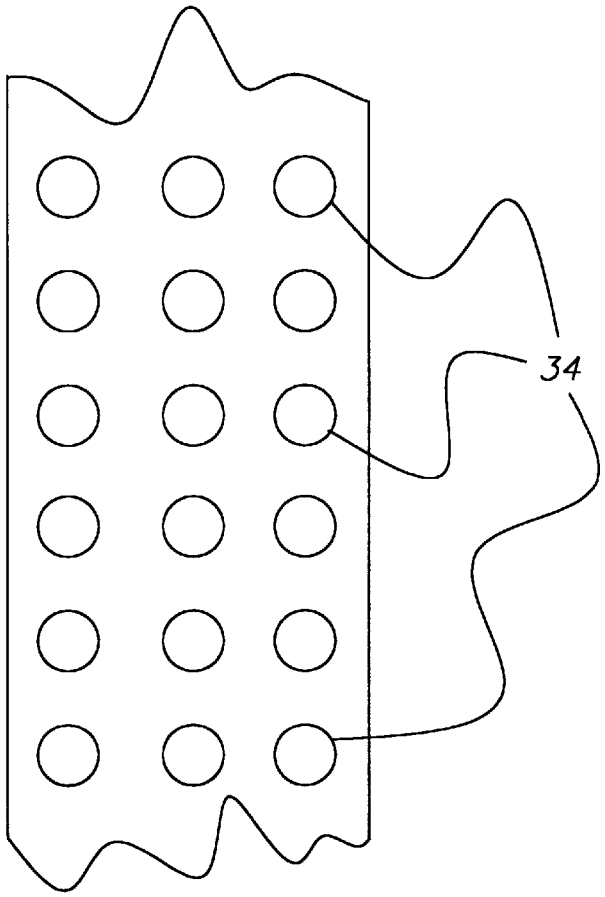
FIG. 5 is an isometric view of opposing web carrier belts.
FIG. 5A is a partial plane view of a web carrier belt showing perforations therein.
Figure 5A:
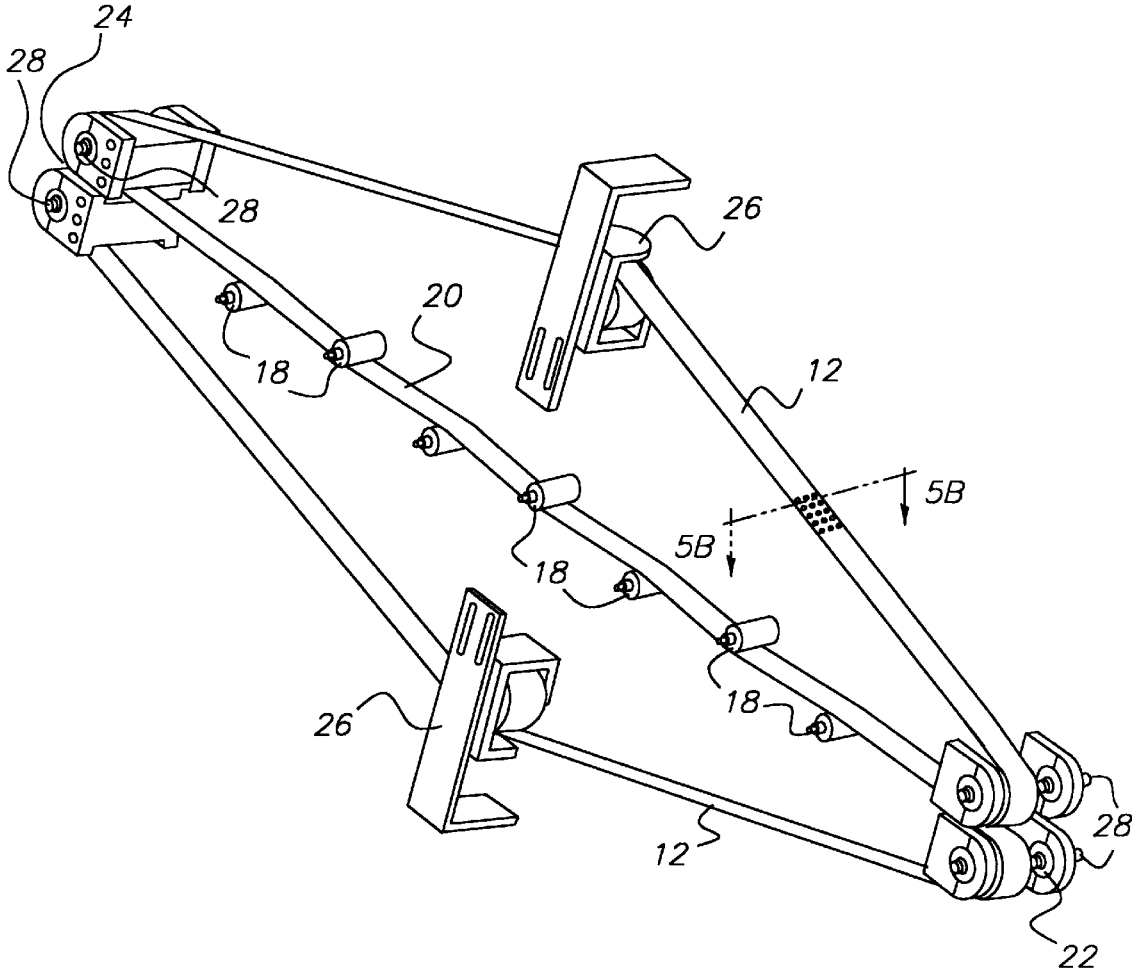

Referring to FIG. 5, first and second web carrier belts 12, 14 each has a plurality of perforations 34 that provide two functions and advantages over prior art teachings. First, the plurality of perforations 34 provides a pathway for evaporation in solvent casting applications. Second, the perforations 34 increase the force required to shrink the web 1 while it is supported on first and second web carrier belts 12, 14.

According to our invention, opposing first web carrier belts 12 and opposing second web carrier belts 14 may have a thickness in the range of about 0.003 inches to about 0.125 inches, 0.090 inches being preferred.

Figure 6:
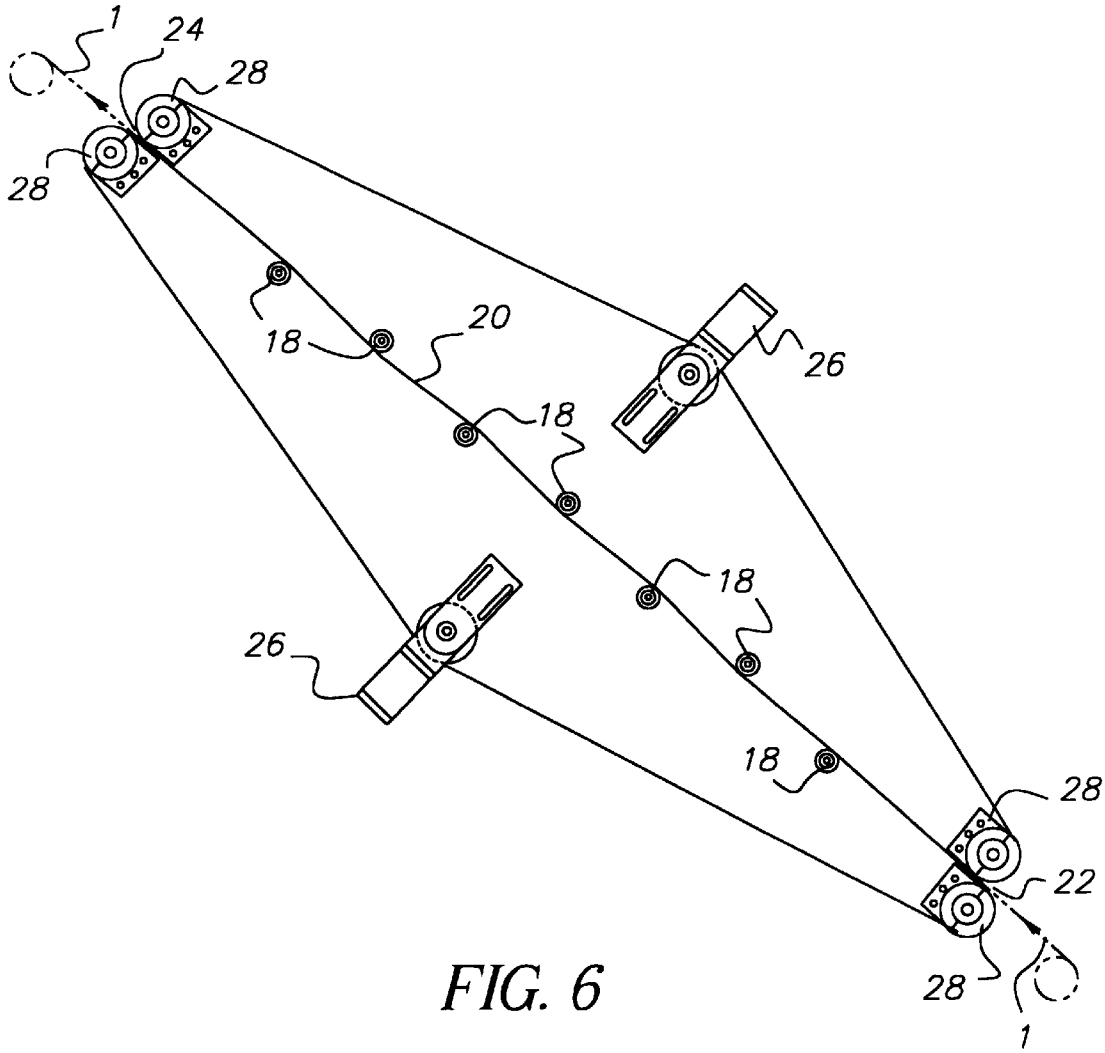
FIG. 6 is a side elevational view of opposing web carrier belts.

Referring to FIGS. 1 and 6, means is provided for rotatably supporting and conforming the opposing first web carrier belts 12 and the opposing second web carrier belts 14 in a generally serpentine web conveyance path 20 having a web ingress lip 22 and an opposing web egress lip 24. The serpentine path 20 is accomplished by offsetting opposing pairs of belt support rollers 18 from the centerline of the web in an alternating manner. The purpose of providing the serpentine path 20 is to create compressive force between opposing first web carrier belts 12 and opposing second web carrier belts 14 at the point of the belt support rollers 18 and thereby create a restraining force to restrict web shrinkage.

Figure 7:
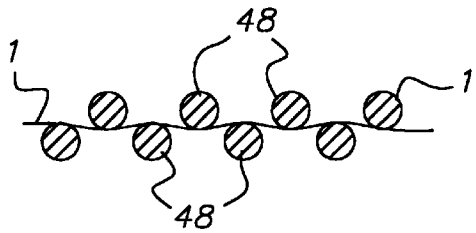
FIG. 7 is an alternate embodiment of a method f forming a serpentine path.

Referring to FIG. 7, an alternative method for forming a serpentine web conveyance path includes providing a plurality of spaced offset support rollers 48 for exerting tension on the web 1 thereby conforming the web 1 to a serpentine path. In this case, the web 1 itself forms the serpentine path rather than following a serpentine path formed by first and second web carrier belts 12, 14 described above.

Figure 4:
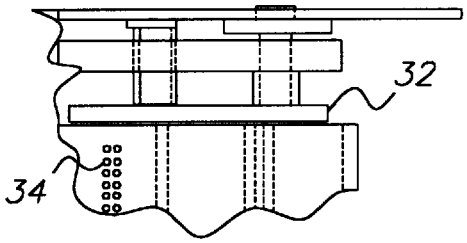
FIG. 4 is a top plan view showing plenum perforations in phamtom.

Referring to FIGS. 1, 3 and 4, a plenum 32 for receiving forced air is arranged in close proximity to the generally serpentine web conveyance path 20 in fluid communications with a plurality of perforations 34. This arrangement of plenum 32 and perforations 34 provides fluid transfer between the plenum 32 and the web 1 moving through the generally serpentine web conveyance path 20. An advantage of supplying plenum 32 is to provide heat transfer and/or mass transfer to and from the moving web 1.

Referring to FIGS. 1–3, and 5–6, means 26 is provided for applying tension to each of the opposing first web carrier belts 12 and to each of the opposing second web carrier belts 14. Tension may be applied through a variety of means including air cylinders, springs, cantilevered weight, etc. In this application, the use of air cylinders is the preferred design for simplicity.

Referring to FIG. 5, means is provided for tracking each of the pair of opposing first and the pair of opposing second web carrier belts 12, 14 (respectively). Tracking is accomplished by changing the geometry of the belt tracking rollers 28 at the web ingress and egress lips 22, 24 of frame 11 (shown in FIGS. 1 and 6). Belt tracking rollers 28 are machined to have a larger diameter in the center and a smaller diameter at the ends. These types of belt tracking rollers 28 are known as chamfered rollers. In our invention, opposing belt tracking rollers 28 are arranged in proximate contact with one another at both the web ingress lip 22 and web egress lip 24.

The invention has been described with reference to a preferred embodiment. However, it will be appreciated that variations and modifications can be effected by a person of ordinary skill in the art without departing from the scope of the invention.

PARTS LIST

1 web
10 apparatus
11 frame
12 opposing first web carrier belt
14 opposing second web carrier belt
18 belt support rollers
20 web conveyance path
22 web ingress lip
24 web egress lip
26 tension means
28 belt tracking rollers
32 plenum
34 perforation
38 drive means
48 offset support rollers

What is claimed is:

1. A method for controlling width-wise contraction of web to be conveyed, comprising the steps of:

(a) providing a source of web to be conveyed;

(b) forming a generally serpentine web conveyance path for supporting the web solely on its edges, the serpentine web conveyance path having an ingress lip to receive said web to be conveyed and an egress lip for releasing said web to be conveyed from said generally serpentine web conveyance path the conveyance path being formed by a pair of opposing first web carrier belts for supporting one lateral edge of said web to be conveyed and a pair of opposing second web carrier belts for supporting the opposite lateral edge of said web to be conveyed and a plurality of spaced offset support rollers for exerting tension on said web carrier belts thereby conforming said web carrier belts to said generally serpentine web conveyance path, and means for applying tension to the carrier belts; and (c) introducing said web to be conveyed into said ingress lip of said generally serpentine web conveyance path for conveyance through said generally serpentine web conveyance path and then through said egress lip of said generally serpentine web conveyance path for subsequent independent treatment.

* * * * *